US006408481B1

(12) United States Patent
Dyson

(10) Patent No.: US 6,408,481 B1
(45) Date of Patent: Jun. 25, 2002

(54) VACUUM CLEANER

(75) Inventor: James Dyson, Wiltshire (GB)

(73) Assignee: Notetry Limited, Wiltshire (GB)

( * ) Notice: Subject to any disclaimer, the term of this patent is extended or adjusted under 35 U.S.C. 154(b) by 0 days.

(21) Appl. No.: 09/581,764

(22) PCT Filed: Dec. 17, 1998

(86) PCT No.: PCT/GB98/03813

§ 371 (c)(1),
(2), (4) Date: Aug. 21, 2000

(87) PCT Pub. No.: WO99/30604

PCT Pub. Date: Jun. 24, 1999

(30) Foreign Application Priority Data

Dec. 17, 1997 (GB) ..... 9726673

(51) Int. Cl.[7] ..... A47L 5/28
(52) U.S. Cl. ..... 15/350; 15/353; 15/410; 15/413
(58) Field of Search ..... 15/350, 351, 352, 15/353

(56) References Cited

U.S. PATENT DOCUMENTS 2,867,833 A * 1/1959 Duff ..... 15/350 X
3,029,461 A * 4/1962 Osborn ..... 15/350 X
3,101,505 A * 8/1963 Belicka et al. ..... 15/320
3,322,101 A * 5/1967 Leinfelt et al. ..... 15/353 X
4,373,228 A 2/1983 Dyson
4,376,322 A * 3/1983 Lockhart et al. ..... 15/351 X
5,558,697 A 9/1996 Dyson et al.
5,564,160 A * 10/1996 Luebbering ..... 15/351
5,836,047 A * 11/1998 Lee et al. ..... 15/351 X
6,289,553 B1 9/2001 Dyson

FOREIGN PATENT DOCUMENTS

DE 30 17 209 A1 11/1981
JP 6-311946 11/1994

* cited by examiner

*Primary Examiner*—Chris K. Moore
(74) *Attorney, Agent, or Firm*—Morrison & Foerster LLP

(57) ABSTRACT

The present invention relates to a vacuum cleaner (1) comprising a first casing (10) housing dust separation apparatus, a second casing (11) housing at least one filter (21, 23) or other component of the vacuum cleaner (1), a central spine (13) housing at least one conduit and forming part of an airflow path within the vacuum cleaner (1), the first and second casings (10, 11) lying generally parallel to one another and the central spine (13) lying at least partly between the first and second casings (10, 11). Such a construction provides a vacuum cleaner having a more compact profile which enables the vacuum cleaner to be used to clean areas where there is a height restriction, for example underneath furniture.

13 Claims, 3 Drawing Sheets

VACUUM CLEANER

BACKGROUND OF THE INVENTION

1. Field of the Invention

The present invention relates to a vacuum cleaner.

2. Description of Related Art

An upright vacuum cleaner generally has a cleaner head rotatably mounted to the lower end of a main body in which dust separation apparatus is housed. A pair of wheels is mounted on the lower end to the main body or on the cleaner head. The cleaner head extends in a forward direction. A dirty air inlet is located at the forward end of the cleaner head and facing downwardly so that, in use, the dirty air inlet rests on the surface to be cleaned. Dirty air is sucked into the dust separation apparatus via the dirty air inlet by means of a fan driven by a motor.

Upright vacuum cleaners are commonly convertible into cylinder cleaners. In the cylinder mode, a wand or hose attached to the vacuum cleaner is used to provide the dirty air inlet instead of the dirty air inlet located in the cleaner head. This mode enables cleaning of confined areas which cannot be easily reached by the cleaner head, for example, stairs, underneath furniture etc.

Such conventional vacuum cleaners are bulky and therefore it is not possible to use the vacuum cleaner in its upright mode to clean some surfaces which are awkward to reach, in particular areas having a height restriction, for example under pieces of furniture such as beds, sofas and chairs. Therefore, to clean these areas it is necessary either to move the piece of furniture, which can be very difficult for large pieces of furniture, or to use the vacuum cleaner in its cylinder cleaning mode, which can be awkward, inconvenient and time consuming. Also, as these cleaners are so bulky, they take up considerable storage space which makes storing the vacuum cleaner, when not in use, difficult or awkward.

U.S. Pat. No. 4,373,228 discloses a vacuum cleaner having two cyclonic separators arranged side by side. A central rod holds an upper casing and a lower casing together. However, the presence of two separate cyclonic separators is a bulky construction and there is no space saving achieved by the provision of the central rod.

SUMMARY OF THE INVENTION

The present invention seeks to provide a vacuum cleaner which is less bulky in order to overcome the above disadvantages.

According to the present invention there is provided a vacuum cleaner comprising a first casing housing dust separation apparatus, a second casing housing at least one filter or other component of the vacuum cleaner, and a central spine, the first and second casings lying generally parallel to one another and the central spine lying at least partly between the first and second casings, wherein the central spine houses at least one conduit forming part of an airflow path within the vacuum cleaner and the conduit extends longitudinally in the same direction as the central spine.

In providing a vacuum cleaner having a central spine which lies partly between separate casing which house the dust separation apparatus and at least one filter or other component, the overall size (i.e. depth) of the cleaner can be minimized. Therefore, the vacuum cleaner can be used to clean areas having a much lower height restriction, as the reduced depth of the cleaner enables it to slide underneath furniture etc. Also the vacuum cleaner is more compact, making it less cumbersome to maneuver or carry and easier to store.

To further minimize the size of the vacuum cleaner, the central spine may lie wholly between the first and second casings.

The casings may be generally cylindrical in shape and arranged such that the longitudinal axis of each casing lies parallel to the longitudinal axis of the central spine. This helps to further reduce the size of the vacuum cleaner.

Further, the vacuum cleaner may comprise a cleaner head in which an inlet for dirty air is located, the cleaner head being rotatable with respect to the central spine and the first and second casings, wherein the depth of each casing is approximately equal to the height of the cleaner head, or wherein the depth of each casing is no greater than the height of the cleaner head. Therefore, when the central spine is tilted rearwardly so that the central spine, casings and cleaner head are almost horizontal, the height of the casings would be approximately the same as, or at least no greater than, the height of the cleaner head. In this horizontal position, the overall height of the vacuum cleaner is minimized, and the vacuum cleaner can be used to clean areas where there is a height restriction, for example underneath beds.

In a preferred embodiment, the vacuum cleaner comprises a conduit for transferring dirty air from an inlet for dirty air into the dust separation apparatus and a conduit for transferring dirty air from the dust separation apparatus to a first filter housed in the second casing. This means that the air flow path within the vacuum cleaner is integral with the central spine, further reducing the size of the cleaner.

To aid maintenance, cleaning and replacement of the dust separation apparatus or filters, the casings may be releasably attached to the central spine.

Preferably, the dust separation apparatus is a cyclonic separator, more preferably a dual cyclonic separator. Preferably, the second casing houses a first and a second filter which may be stacked coaxially on top of one another.

BRIEF DESCRIPTION OF THE DRAWINGS

An embodiment of the invention will now be described and fully explained with reference to the accompanying drawings, wherein.

DETAILED DESCRIPTION OF THE INVENTION

Figure 1:
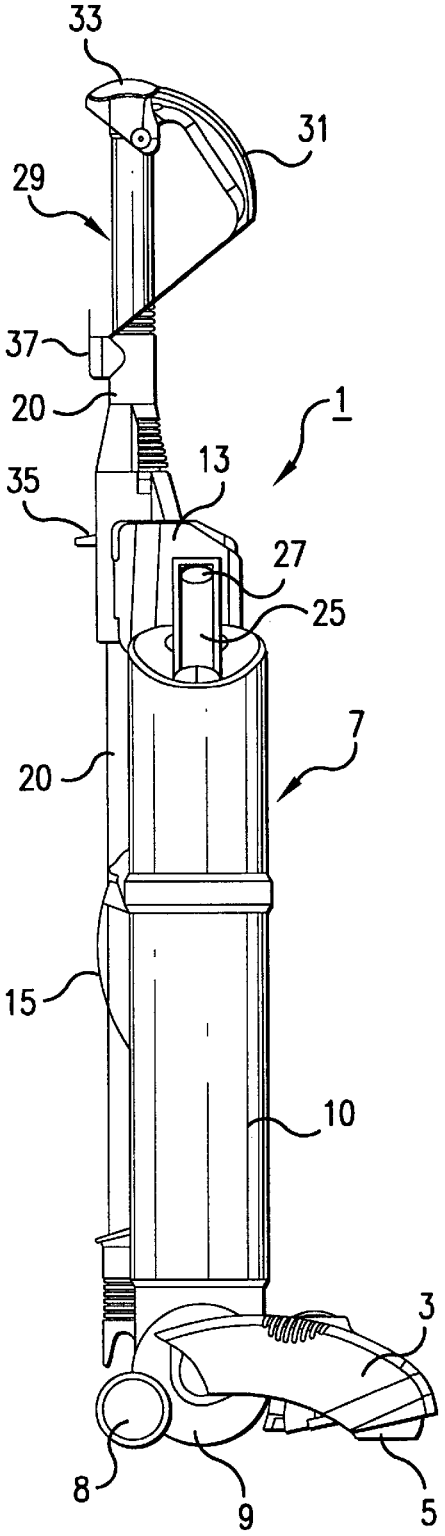
FIG. 1 is a side view of a vacuum cleaner according to the present invention.
Figure 2:
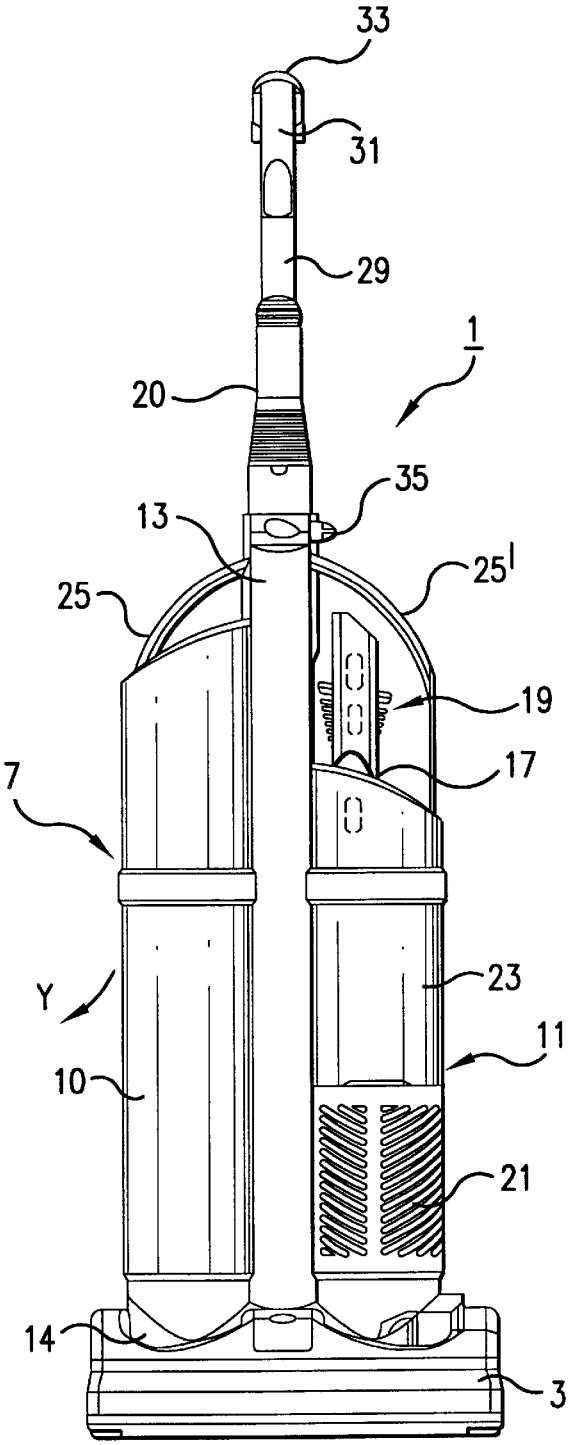
FIG. 2 is a front view of the vacuum cleaner of FIG. 1.
Figure 3:
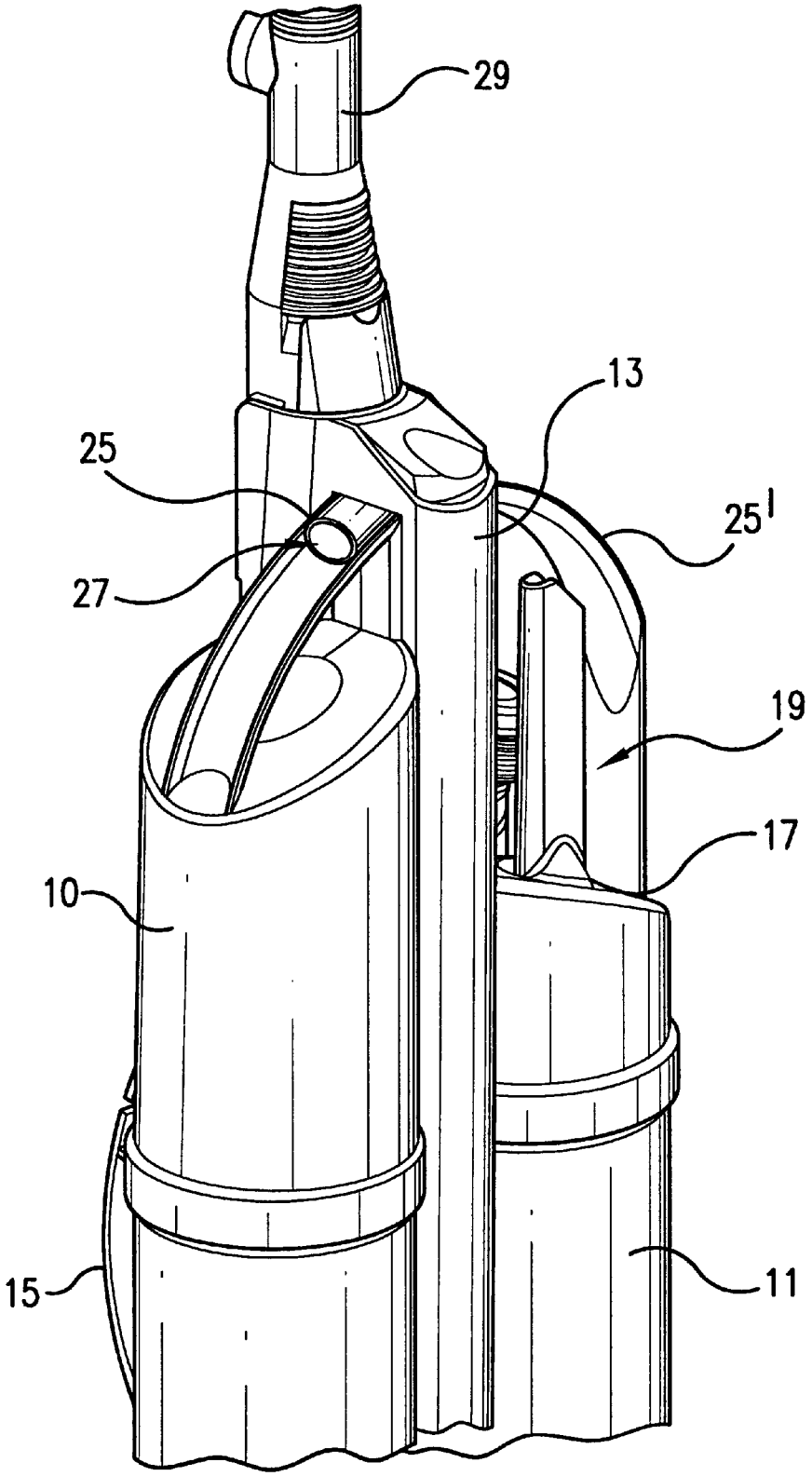
FIG. 3 shows the detail of the release mechanism of the casings of the vacuum cleaner of FIG. 1.

With reference to the FIGS. 1 to 3, the vacuum cleaner 1 of the present invention comprises a cleaner head 3 having a downwardly directing dirty air inlet 5 at its forward end. The cleaner head 3 extends in a forward direction and is rotatably attached to the lower end of the main body 7 of the vacuum cleaner 1 via a motor housing 9. The motor housing 9 is generally cylindrical and extends across the width of the cleaner head 3. A pair of wheels 8 is mounted onto the motor housing 9 at the rear of the vacuum cleaner 1.

The main body 7 comprises a first casing 10 and a second casing 11 releasably attached to a central spine 13. The first and second casings 10, 11 are generally cylindrical. The longitudinal axis of each casing lies parallel to the longitudinal axis of the central spine 13. The central spine 13 lies wholly between the first and second casings 10, 11.

The casings 10, 11 and the central spine 13 are fixed onto the motor housing 9 so that the longitudinal axis of the motor housing 9 is perpendicular to the longitudinal axis of the central spine 13 and the first and second casings 10, 11. The first and second casings 10, 11 are supported on either side of the central spine 13 so that the casings 10, 11 and the central spine 13 are in alignment along the length of the motor housing 9. The base of each casing 10, 11 fits into a complementary recess 14 of the motor housing 9. The diameter of each of the casings 10, 11 is approximately equal to the diameter of the motor housing 9 and is approximately equal to, or at least no greater than, the height of the cleaner head 3.

A wand 20 is releasably attached to the rear of the central spine 13 of the vacuum cleaner 1. The wand 20 comprises a generally straight hollow tube. It is detached from the central spine and used as the dirty air inlet when the cleaner is used in its cylinder cleaning mode as in known cleaners.

Figure 4:
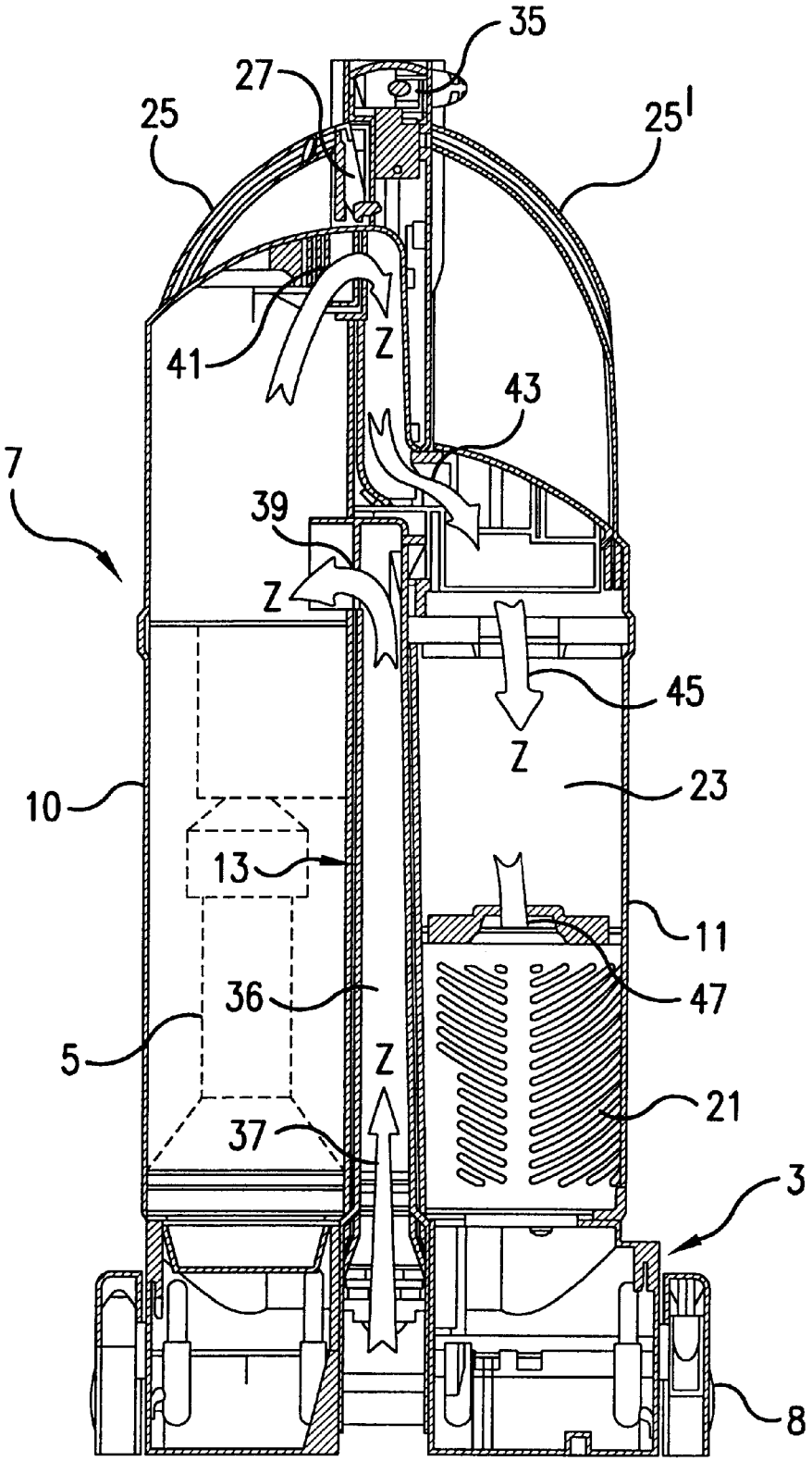
FIG. 4 shows the internal detail and air flow path of the vacuum cleaner of FIG. 1.

The first casing 10 houses a dust separation apparatus, for example a dual cyclonic separator S (shown in dotted lines on FIG. 4). The first casing 10 has a handle 15 extending outwardly from the rear of the main body of the vacuum cleaner to facilitate removal for emptying purposes.

The second casing 11 houses a first filter 23 stacked coaxially on top of a second filter 21. The upper portion of the second casing 11 comprises an accessory tool holder 17 for holding accessory tools 19 for attachment to the wand 20 of the vacuum cleaner 1 for use as the dirty air inlet in the cylinder cleaning mode.

The first casing 10 has an upwardly extending curved handle 25. The upper end of the handle 25 is releasably attached to the central spine 13 by a release mechanism 27 which may be a push-catch. The casing 10 can be released from the vacuum cleaner by pushing the catch 27 in the direction of the arrow X shown in FIG. 3. The casing 10 can then be pulled away from the central spine 13 in the directions of the arrow Y shown in FIG. 2 and lifted out of the recesses 14 of the motor housing 9. The second casing 11 can be made accessible by similar or alternative fastening meals. The second casing has a handle 25' for aesthetic purposes and which can also function as a handle for lifting the vacuum cleaner off the floor if necessary.

The central spine 13 comprises a conduit 36 for transferring dirty air from the dirty air inlet 5 into the dust separation apparatus housed within the first housing 10 and a conduit for transferring dirty air from the dust separation apparatus into the second casing 11 housing the filters 21, 23. Details of this are illustrated in FIG. 4. The dirty air flows in the direction of the arrows Z indicated in FIG. 4. The dirty air flows through the cleaner head 3 and enters the base of the conduit 36 of the central spine 13 via the inlet 37. The dirty air then flows upwards towards an outlet 39 at the top of the conduit and into the dust separating apparatus, in this case a dual cyclonic separator, housed in the first casing 10. Particles in the dirty air are separated out by the cyclonic separator. The cleaned air flows out of the separator via an outlet 41 and then passes through the first filter 23 and the second filter 21 via the inlets 43, 45 and 47 before exiting to the atmosphere. The airflow is also used to cool the motor before passing through the second filter 21.

The wand 20 extends upwardly from the central spine 13 and the casings 10, 11. The upper portion of the wand 20 forms a handle 29 having a gripping portion 31 extending forwardly and downwardly from the upper end of the wand 20. The open, upper end of the wand 20 is sealed by a cap 33 which is movable between a closed and open position. The cap 33 extends in a rearward direction to form a hook integral with the cap 33 so that the cleaner can be hung up on a wall.

The power supply for the motor housed in the motor housing 9 is provided via a cable which enters the central spine at a point 35 just above the handle 25 of the first casing 10. The cable extends down the central spine 13 to the motor housing 9 for electrical connection to the motor. The external part of the cable (not shown) is wrapped in a loop at the rear of the vacuum cleaner via a hook 37 fitted on the wand 20 when not in use.

In use, the user grasps the gripping portion 31 of the handle 29 and tilts the main body 7 of the vacuum cleaner I towards himself so that the cleaner head 3 extends in a forward direction. The vacuum cleaner is moved across the surface to be cleaned, and dirty air is sucked up through the dirty air inlet 5 into the cleaner head 3 and then into the dust separation apparatus housed in the first casing 10 by means of a fan driven by the motor.

Due to the reduced profile of the vacuum cleaner, it can be extended into areas where there is a height restriction, for example, underneath furniture. The vacuum cleaner is arranged so that the main body 7 can be tilted rearwardly so that the main body 7 and the cleaner head 3 are horizontal. In order to minimize the overall height of the vacuum cleaner 1 the diameter of the casings 10 and 11 is such that it is approximately equal to the height of the cleaner head 3, or at least no greater than the height of the cleaner head. The clearance height of the vacuum cleaner is preferably around 140 mm.

The motor housing 9 is constructed to have minimal dimensions and has a diameter approximately equal to the diameter of the first and second casings 10 and 11. The pair of wheels 8 at the rear of the vacuum cleaner 1 is also minimized in size. This helps to reduce the overall size of the vacuum cleaner and to reduce its weight to make it more compact.

In the light of this disclosure, modifications and equivalents of the described embodiment as well as other embodiments within the scope of the appended claims will now become apparent to a person skilled in the art.

What is claimed is:

1. A vacuum cleaner comprising:

a body and a cleaner head, the body comprising a first casing, a second casing, a central spine and a handle, the first casing housing a dust separation apparatus and the second casing housing at least one filter or other vacuum cleaner component, the first and second casings having longitudinal axes lying generally parallel to one another, the central spine lying at least partly between the first and second casings and comprising at least one conduit and forming part of an airflow path within the vacuum cleaner, the conduit extending longitudinally from the cleaner head in the same direction as the central spine, the handle extending upwardly from the body and configured to allow a user to maneuver the vacuum cleaner, the cleaner head having wheels mounted thereon so as to allow the vacuum cleaner to be moved in a forward direction;

wherein the first and second casings are laterally spaced along a line substantially perpendicular to the forward direction.

2. A vacuum cleaner according to claim 1, wherein the central spine lies wholly between the first and second casings.

3. A vacuum cleaner according to claim 1, wherein each casing is generally cylindrical, and each casing has a longitudinal axis lying parallel to a longitudinal axis of the central spine.

4. A vacuum cleaner according to claim 1 or 2, wherein the cleaner head comprises an inlet for dirty air, the cleaner head having a height and being rotatable with respect to the first and second casings and the central spine, and wherein each casing has a depth that is approximately equal to the height of the cleaner head.

5. A vacuum cleaner according to claim 1, wherein the second casing houses a first filter.

6. A vacuum cleaner according to claim 1, wherein the conduit is configured for transferring dirty air from a dirty air inlet in the cleaner head into the dust separation apparatus and wherein the central spine comprises a second conduit for transferring dirty air from the dust separating apparatus to a first filter.

7. A vacuum cleaner according to claim 1, wherein at least one of the casings is releasably attached to the central spine.

8. A vacuum cleaner according to claim 7, wherein the first and second casings are releasably attached to the central spine.

9. A vacuum cleaner according to claim 1, wherein the dust separating apparatus includes a cyclonic separator.

10. A vacuum cleaner according to claim 9, wherein the separator is a dual cyclonic separator.

11. A vacuum cleaner according to claim 1, wherein the second casing houses a first filter and a second filter.

12. A vacuum cleaner according to claim 11, wherein the first filter and the second filter are stacked coaxially on top of one another.

13. A vacuum cleaner according to claim 1 or 2, wherein the vacuum cleaner comprises a cleaner head in which an inlet for dirty air is located, the cleaner head being rotatable with respect to the first and second casings and the central spine, and wherein each casing has a depth that is not greater than a height of the cleaner head.

* * * * *

UNITED STATES PATENT AND TRADEMARK OFFICE

CERTIFICATE OF CORRECTION

PATENT NO. : 6,408,481 B1
DATED : June 25, 2002
INVENTOR(S) : James Dyson

It is certified that error appears in the above-identified patent and that said Letters Patent is hereby corrected as shown below:

Titlt page,
Item [56], References Cited, please delete the fourth cited reference "3,322,101 * 5/1967 and replace with -- 3,332,101 * 7/1967 --.

Column 3,
Line 44, please delete "meals" and replace with -- means --.

Column 4,
Line 18, please delete "I" and replace with -- 1 --.

Signed and Sealed this

Seventh Day of January, 2003

JAMES E. ROGAN
*Director of the United States Patent and Trademark Office*